US009625129B2

(12) United States Patent
Jiang et al.

(10) Patent No.: US 9,625,129 B2
(45) Date of Patent: Apr. 18, 2017

(54) LED TUBE LIGHT

(71) Applicant: JIAXING SUPER LIGHTING ELECTRIC APPLIANCE CO., LTD, Jiaxing (CN)

(72) Inventors: Tao Jiang, Jiaxing (CN); Li-Qin Li, Jiaxing (CN)

(73) Assignee: Jiaxing Super Lighting Electric Appliance Co., Ltd., Jiaxing, Zhejiang (CN)

( * ) Notice: Subject to any disclaimer, the term of this patent is extended or adjusted under 35 U.S.C. 154(b) by 0 days.

(21) Appl. No.: 14/677,899

(22) Filed: Apr. 2, 2015

(65) Prior Publication Data

US 2016/0091179 A1 Mar. 31, 2016

(30) Foreign Application Priority Data

| | | |
|---|---|---|
| Sep. 28, 2014 | (CN) | 2014 1 0507660 |
| Sep. 28, 2014 | (CN) | 2014 1 0508899 |
| Nov. 6, 2014 | (CN) | 2014 1 0623355 |
| Dec. 5, 2014 | (CN) | 2014 1 0734425 |
| Feb. 12, 2015 | (CN) | 2015 1 0075925 |

(51) Int. Cl.
*F21V 7/20* (2006.01)
*F21V 19/00* (2006.01)
(Continued)

(52) U.S. Cl.
CPC ..... *F21V 19/009* (2013.01); *F21K 9/27* (2016.08); *F21K 9/272* (2016.08); *F21Y 2103/10* (2016.08); *F21Y 2115/10* (2016.08)

(58) Field of Classification Search
CPC ..... F21Y 2103/00
(Continued)

(56) References Cited

U.S. PATENT DOCUMENTS 3,294,518 A * 12/1966 Laseck ..... C03B 27/0447 65/114
4,156,265 A 5/1979 Rose
(Continued)

FOREIGN PATENT DOCUMENTS

CN 102518972 A 6/2012
CN 203240337 U 10/2013
(Continued)

*Primary Examiner* — Jong-Sk (James) Lee
*Assistant Examiner* — Tsion Tumebo
(74) *Attorney, Agent, or Firm* — Muir Patent Law, PLLC

(57) ABSTRACT

An LED tube light having a substantially uniform exterior diameter from end to end is disclosed. It has a glass light tube with narrowly curved end regions at ends for engaging with end caps, in which outer diameter of each end cap is equal to outer diameter of light tube. LED tube light also include a thermal conductive ring. The narrowly curved end region is formed by glass tempering. End caps are joined to the light tube by sleeving over the rear end regions with a hot melt adhesive disposed between the rear end region, the transition region, the insulating tubular part and the thermal conductive ring. An outer diameter of thermal conductive ring is the same as the outer diameter of the main region of the light tube. The transition region is curved, and an outer diameter of rear end region is less than that of the main region.

19 Claims, 14 Drawing Sheets

(51) Int. Cl.

| | |
|---|---|
| ***F21K 9/27*** | (2016.01) |
| ***F21K 9/272*** | (2016.01) |
| *F21Y 103/10* | (2016.01) |
| *F21Y 115/10* | (2016.01) |

(58) Field of Classification Search
USPC ..... 362/217.14, 225, 217.05, 217.16, 217.17
See application file for complete search history.

(56) References Cited

U.S. PATENT DOCUMENTS 4,647,399 A * 3/1987 Peters ..... H01J 61/44 252/301.4 H
5,536,998 A * 7/1996 Sica ..... F21V 17/04 313/25
5,575,459 A * 11/1996 Anderson ..... 362/240
5,921,660 A * 7/1999 Yu ..... 362/249.03
5,998,921 A * 12/1999 Nakaya ..... H01J 61/0672 313/234
6,127,783 A 10/2000 Pashley
6,211,262 B1 * 4/2001 Mejiritski ..... C09D 4/00 522/100
6,561,690 B2 5/2003 Balestriero
6,609,813 B1 8/2003 Showers
6,762,562 B2 7/2004 Leong
6,796,680 B1 9/2004 Showers
7,033,239 B2 * 4/2006 Cunkelman ..... H01J 5/58 445/26
7,067,032 B1 * 6/2006 Bremont ..... F16L 13/103 156/272.2
7,178,941 B2 2/2007 Roberge
7,267,461 B2 9/2007 Kan
7,654,703 B2 2/2010 Kan
7,878,683 B2 2/2011 Logan
8,207,821 B2 6/2012 Roberge
8,360,599 B2 * 1/2013 Ivey et al. ..... 362/218
8,408,741 B2 4/2013 Logan
8,434,897 B2 5/2013 Logan
8,579,463 B2 * 11/2013 Clough ..... 362/217.13
2003/0231485 A1 * 12/2003 Chien ..... 362/84
2005/0168123 A1 * 8/2005 Taniwa ..... H01J 29/76 313/441
2006/0028837 A1 * 2/2006 Mrakovich ..... G02B 6/001 362/602
2007/0210687 A1 * 9/2007 Axelsson ..... 313/26
2008/0030981 A1 * 2/2008 Mrakovich et al. ..... 362/219
2008/0192476 A1 * 8/2008 Hiratsuka ..... 362/285
2010/0253226 A1 * 10/2010 Oki ..... F21K 9/135 315/113
2011/0038146 A1 * 2/2011 Chen ..... F21V 19/001 362/225
2012/0106157 A1 * 5/2012 Simon et al. ..... 362/249.05
2012/0153873 A1 6/2012 Hayashi
2012/0169968 A1 * 7/2012 Ishimori ..... G02B 6/0023 349/62
2013/0050998 A1 2/2013 Chu
2013/0170245 A1 7/2013 Hong
2013/0182425 A1 * 7/2013 Seki ..... F21K 9/17 362/217.05
2013/0215609 A1 * 8/2013 Liu ..... F21K 9/175 362/223
2014/0071667 A1 3/2014 Hayashi
2014/0153231 A1 * 6/2014 Bittmann ..... F21K 9/1355 362/217.14
2014/0226320 A1 * 8/2014 Halliwell et al. ..... 362/217.01
2015/0009688 A1 1/2015 Timmermans

FOREIGN PATENT DOCUMENTS

WO WO2011/132120 A1 10/2011
WO WO2013/125803 A1 8/2013
WO WO2014/001475 A1 1/2014
WO WO2015/036478 A1 3/2015

* cited by examiner

LED TUBE LIGHT

FIELD OF THE INVENTION

The present invention relates to an LED tube light, and more particularly to an LED tube light having a substantially uniform exterior diameter from end to end thereof.

BACKGROUND OF THE INVENTION

Today LED lighting technology is rapidly replacing traditional incandescent and fluorescent lights. Even in the tube lighting applications, instead of being filled with inert gas and mercury as found in fluorescent tube lights, the LED tube lights are mercury-free. Thus, it is no surprise that LED tube lights are becoming highly desired illumination option among different available lighting systems used in homes and workplace, which used to be dominated by traditional lighting options such as compact fluorescent light bulbs (CFLs) and fluorescent tube lights. Benefits of the LED tube lights include improved durability and longevity, and far less energy consumption, therefore, when taking into of all factors, they would be considered as cost effective lighting option.

There are several types of LED tube lights that are currently available on the market today. Many of the conventional LED tube light has a housing that use material such as an aluminum alloy combined with a plastic cover, or made of all-plastic tube construction. The lighting sources usually adopt multiple rows of assembled individual chip LEDs (single LED per chip) being welded on circuit boards, and the circuit boards are secured to the heat dissipating housing. Because this type of aluminum alloy housing is a conductive material, thus is prone to result in electrical shock accidents to users. In addition, the light transmittance of the plastic cover or the plastic tube diminish over time due to aging, thereby reducing the overall lighting or luminous efficiency of the conventional LED tube light. Furthermore, grainy visual appearance and other derived problems reduce the luminous efficiency, thereby reducing the overall effectiveness of the use of LED tube light.

Referring to US patent publication no. 2014226320, as an illustrative example of a conventional LED tube light, the two ends of the tube are not curved down to allow the end caps at the connecting region with the body of the lamp tube (including a lens, which typically is made of glass or clear plastic) requiring to have a transition region. During shipping or transport of the LED lamp tube, the shipping packaging support/bracket only makes direct contact with the end caps, thus rendering the end caps as being the only load/stress points, which can easily lead to breakage at the transition region with the glass lens.

With regards to the conventional technology directing to glass tube of the LED tube lamps, LED chip on board is mounted inside the glass-tubed tube lamp by means of adhesive. The end caps are made of a plastic material, and are also secured to the glass tube using adhesive, and at the same time the end cap is electrically connected to the power supply inside tube lamp and the LED chip on boards. This type of LED tube lamp assembly technique resolves the issue relating to electrical shocks caused by the housing and poor luminous transmittance issues. But this type of conventional tube lamp configured with the plastic end caps requires a tedious process for performing adhesive bonding attachment because the adhesive bonding process requires a significant amount to time to perform, leading to production bottleneck or difficulties. In addition, manual operation or labor are required to perform such adhesive bonding process, thus would be difficult for manufacturing optimization using automation.

In addition, the glass tube is a fragile breakable part, thus when the glass tube is partially broken in certain portion thereof, would possibly contact the internal LED chip on boards when illuminated, causing electrical shock incidents. Referring to Chinese patent publication no. 102518972, which discloses the connection structure of the lamp caps and the glass tube, as shown in FIG. 1 of the aforementioned Chinese patent reference, it can be seen that the lamp end cap protrudes outward at the joining location with the glass tube, which is commonly done in the conventional market place. According to conducted studies, during the shipping process of the LED tube lamps, the shipping packaging support/bracket only makes contact with the lamp end caps, which make the end caps as being the only load/stress points, which can easily lead to breakage at the transition coupling regions at the ends of the glass tube. In addition, with regards to the secure mounting method of the lamp end caps and the glass tube, regardless of whether using hot melt adhesive or silicone adhesive, it is hard to prevent the buildup and light blockage of excess (overflown) leftover adhesive residues, as well as having unpleasant aesthetic appearance thereof. In addition, large amount of manpower is required for cleaning off of the excessive adhesive buildup, creating further production bottleneck and inefficiency. As shown also from FIGS. 3 and 4 of the aforementioned Chinese patent application, the LED lighting elements and the power supply module require to be electrically connected via wire bonding technique, and can be a problem or issue during shipping due to the concern of breakage.

Based on the above, it can be appreciated that the LED tube light fabricated according to the conventional assembly and fabrication methods in mass production and shipping process can experience various quality issues. Referring to US patent publication no. 20100103673, which discloses of an end cap substitute for sealing and inserting into the housing. However, based on various experimentation, upon exerting a force on the glass housing, breakages can easily occur, which lead to product defect and quality issues. Meanwhile, grainy visual appearances are also often found in the aforementioned conventional LED tube light.

SUMMARY OF THE INVENTION

To solve one of the above problems, the present invention provides a LED tube light having a substantially uniform exterior diameter from end to end thereof by having a glass light tube having one or more narrowly curved end regions at two ends thereof for engaging with a plurality of end caps, and the end caps are enclosing around the narrowly curved end regions of the glass light tube, in which the outer diameter of the end caps is substantially equal to the outer diameter of the light tube thereby forming the LED tube light of substantially uniform exterior diameter from end to end thereof.

The present invention provides an LED tube light that includes a plurality of LED light sources, a LED light bar, a light tube, at least one end cap and at least one power supply.

The present invention provides an LED tube light that includes a plurality of chip LEDs, an LED light bar, a light tube, at least two end caps, an insulation adhesive, an optical adhesive, a hot melt adhesive, a bonding adhesive, and at least one power supply.

The present invention provides two end caps, each equipped with one power supply.

The present invention provides the chip LEDs/(chip LED modules) mounted and fixed on the inside wall of the glass light tube by the bonding adhesive. The chip LED has a female plug, and containing a LED light source. The end cap is configured with a plurality of hollow conductive pins, and a power supply installed therein, where the power supply at one end thereof has a male plug, while the other end thereof has a metal pin. The male plug of the power supply is engageably fittingly inserted into the female plug of the chip LED. The other end of the power supply with the metal pin is inserted into the hollow conductive pin, thereby enabling an electrical connection. The power supply can be of one singular unit (which is disposed in one end cap) or two units located in two end caps, respectively. In an embodiment having a singular narrowly curved end region and a singular power supply, the power supply is preferred to be disposed in the end adjacent to the corresponding singular narrowly curved end region of the glass tube.

The present invention provides the insulation adhesive coated and encapsulated over the chip LEDs, while the optical adhesive is coated and encapsulated over the surfaces of the LED light source (LED chip). Thus, the entire chip LED is thereby electrically insulated from the outside, so that even when the light tube is partially broken into pieces, would not cause electrical shock. The end caps are secured by using a hot melt adhesive, for completing the assembling of the LED tube light of present invention.

In alternative embodiment, the light tube can be a plastic tube, and in several embodiments, the light tube is a glass tube.

The present invention provides the glass light tube to be curved and narrowly at the opening regions or end regions thereof, so as to be narrower in diameter at the ends thereof. The hot melt adhesive is used to secure the end caps to the narrowly curved end region of the light tube, so that the end region is restricted to a "transition region". The hot melt adhesive is prevented from spillover or forming a flash region due to the presence of excessive adhesive residues. The outer diameter of the end cap and the outer diameter of the glass light tube should have a difference therebetween with an average tolerance of up to +/−0.2 mm, with the maximum tolerance up to +/−1 mm. Due to the substantial aligning of the center line of the end cap and the center line of the glass light tube combined with the fact that the width/outer diameter of the end cap and the outer diameter of the glass light tube (in the middle region of the light tube, but not including the two narrowly curved end regions at the ends thereof) are substantially equal, so that the entire LED tube light (assembly) appears to have an integrated planar flat surface. As a result, during shipping or transport of the LED tube light, the shipping packaging support or bracket would not just only make direct contact with the end caps, but also the entire LED tube light, including the glass light tube, thus entire span or length of the LED tube light serves or functions as being multiple load/stress points, which thereby distribute the load/stress more evenly over a wider surface, and can lead to lesser risks for breakage of the glass light tube.

The present invention provides the hot melt adhesive (includes a so-called commonly known as "weld mud powder") included in the LED tube light to have the following material compositions: phenolic resin 2127, shellac, rosin, calcium carbonate powder, zinc oxide, and ethanol.

The present invention provides the glass curved end region of the light tube to be coated by the hot melt adhesive, which when undergone heating, would be greatly expanded, so as to allow tighter and closer contact between the end cap and the glass light tube, thus allowing for realization of manufacturing automation for LED tube lights. In addition, due to the hot melt being a thermosetting plastic, thus is not susceptible to reliability problems or threats due to higher temperature operating conditions or power supply modules giving off heating. Therefore, when the glass light tubes are connected or coupled to the end caps fitted with the power supply, the embodiment of present invention can prevent the reduction of adhesion or adhesiveness between the bonding together of the end caps and the glass light tube when operating under higher temperature conditions or when the power supply module is giving off heating. Thus, the life expectancy and long term reliability of the LED tube light can be thereby extended.

The present invention provides embodiments of the light tube to have a glass tube with just one narrowly curving end region, or with two narrowly curving end regions located at opposite ends thereof.

The present invention provides the power supply for the LED tube light may be in the form of a singular unit, or two individual units, and the power supply can be purchased readily from the marketplace because it is of conventional design.

The present invention provides the LED light bar that is adhesively mounted and secured on the inner wall of the housing, thereby has the illumination angle of at least 330 degrees.

In a preferred embodiment, the light tube can be a transparent glass tube, or a glass tube with coated diffusion film or coated adhesive film on the inner walls thereof.

The present invention provides the adhesive film material to have the following material composition and thickness: methyl vinyl silicone oil, hydro silicone oil, xylene, and calcium carbonate, the thickness can be between 10 to 800 microns (μm), but the preferred thickness can between 100 to 140 microns (μm). The chemical formula for methyl vinyl silicone oil is: $(C_2H_8OSi)n.C_2H_3$. The chemical formula of hydrosilicon oil is: $C_3H_9OSi.(CH_4OSi)n.C_3H_9Si$; and the product produced is polydimethylsiloxane (silicone elastomer), which has chemical formula as follow:

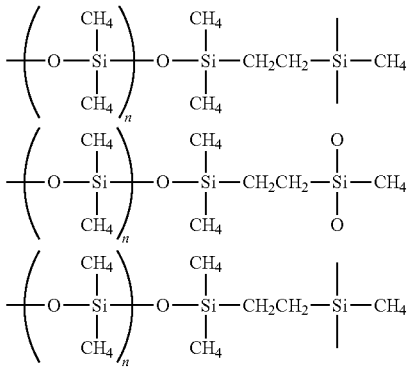

The present invention provides that in a preferred embodiment, the coating thickness of the optical adhesive on the LED light source is between 1.1 millimeter (mm) to 1.3 millimeter (mm), which is clear or transparent in color. An optimal value of the refractive index of the optical adhesive is the square root of the refractive index of the LED light source, so as to produce optimal illumination efficiency. An acceptable range for the refractive index for the optical adhesive is between 1.22 to 4.26. A preferred range for the refractive index for the optical adhesive is between 1.225 to 4.253. The optical adhesive being transparent allows for improved light transmittance, and also provide insulating function.

One benefit of the LED tube light fabricated in accordance with the embodiments of present invention is that the glass light tube containing an adhesive film layer would allow the broken glass pieces to be adhere together even upon breakage thereof, without forming shattered openings, thus can preventing accidental electrical shock caused by physical contact of the internal electrical conducting elements residing inside the glass light tube by someone, at the same time, through having the adhesive film layer of this type of material composition, would also include light diffusing and light transmitting properties, so as to achieve more evenly distributed LED light tube illumination, and higher light transmittance. In an embodiment, the glass light tube is coated with the adhesive film layer on its inside wall surface, the adhesive film layer is made primarily of calcium carbonate, along with a thickening agent, ceramic activated carbon, and deionized water, which are mixed and combined together to be evenly coated on the side wall surface of the glass tube, with average thickness of 20~30 microns, which can lead to about 90% transmittance value. Finally, the deionized water is evaporated, so as to leave behind the calcium carbonate, the thickening agent, and the ceramic activated carbon.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
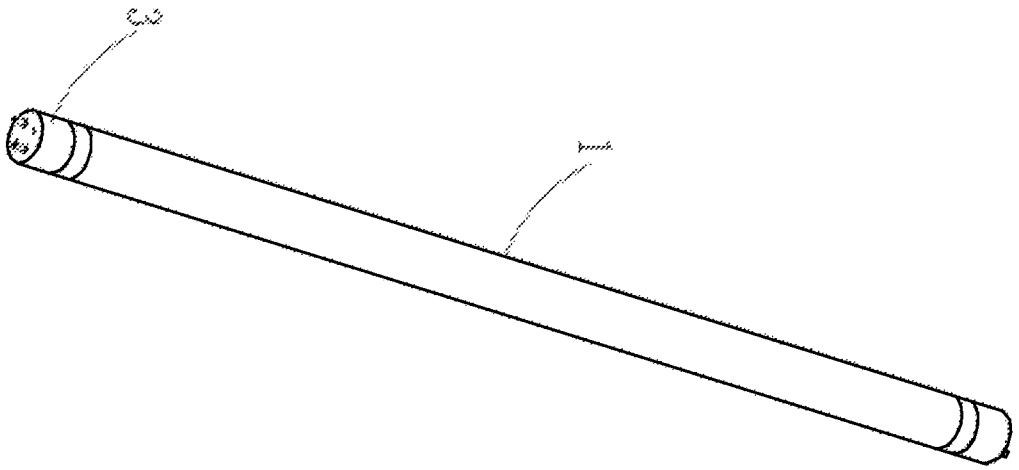
FIG. 1 is a perspective view of an LED tube light according to an embodiment of the present invention.
Figure 2:
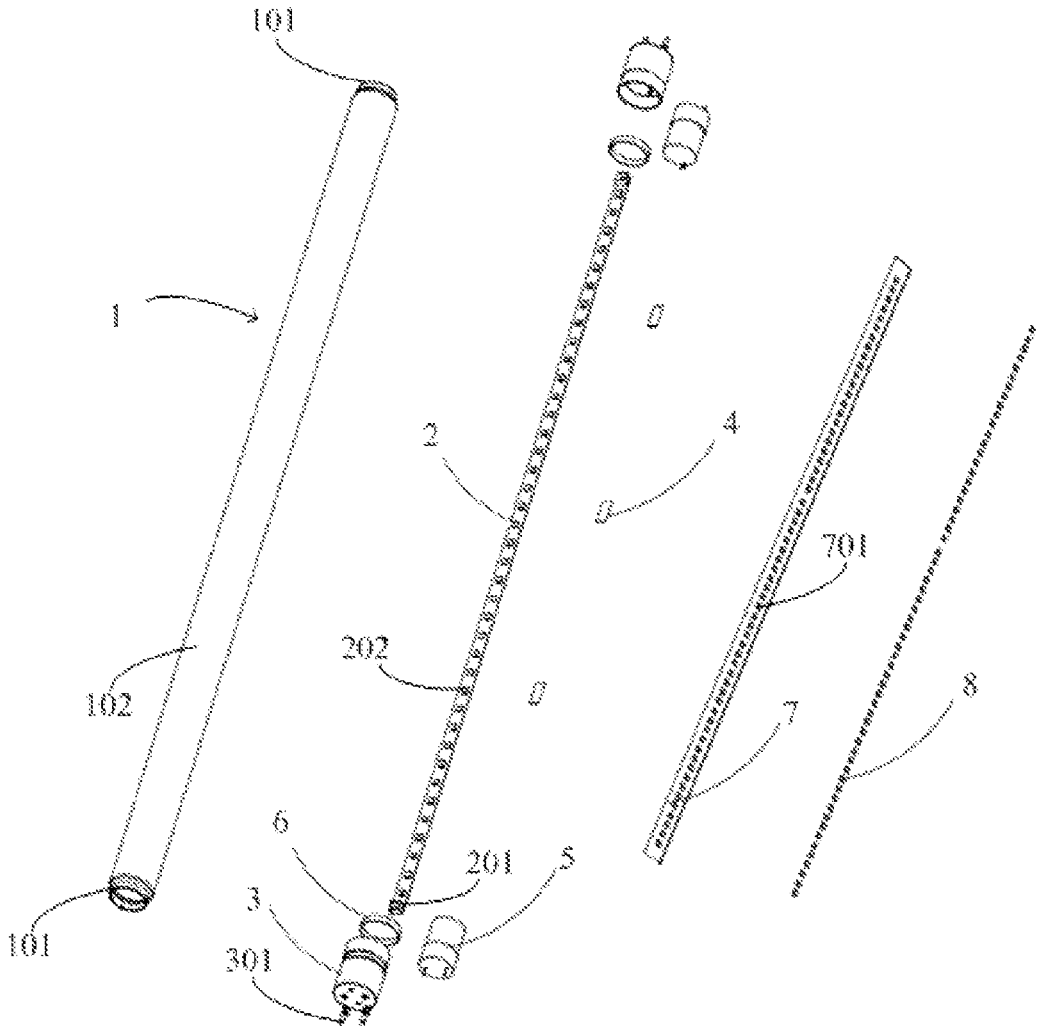
FIG. 2 is an exploded view of a disassembled LED tube light according to the embodiment of the present invention.

According to an embodiment of present invention, an LED tube light is shown in FIGS. 1 and 2, in which the LED tube light includes at least a light tube 1, an LED light bar 2, and two end caps 3. The LED light bar 2 is disposed inside the light tube 1 when assembled. The two end caps 3 are disposed at the two ends of the light tube, respectively. The light tube 1 can be made of plastic or glass.

In the present embodiment, the light tube 1 is made of tempered glass. The method for strengthening or tempering of glass tube can be done by a chemical tempering method or a physical tempering method for further processing on the glass light tube 1. For example, the chemical tempering method is to use other alkali metal ions to exchange with the Na ions or K ions to be exchanged. Other alkali metal ions and the sodium (Na) ions or potassium (K) ions on the glass surface are exchanged, in which an ion exchange layer is formed on the glass surface. When cooled to room temperature, the glass is then under tension on the inside, while under compression on the outside thereof, so as to achieve the purpose of increased strength, including but not limited to the following glass tempering methods: high temperature type ion exchange method, the low temperature type ion exchange method, dealkalization, surface crystallization, sodium silicate strengthening method. High-temperature ion exchange method includes the following steps. First, glass containing sodium oxide ($Na_2O$) or potassium oxide ($K_2O$) in the temperature range of the softening point and glass transition point are inserted into molten salt of lithium, so that the Na ions in the glass are exchanged for Li ions in the molten salt. Later, the glass is then cooled to room temperature, since the surface layer containing Li ions has different expansion coefficient with respect to the inner layer containing Na ions or K ions, thus the surface produces residual stress and is reinforced. Meanwhile, the glass containing $AL_2O_3$, $TiO_2$ and other components, by performing ion exchange, can produce glass crystals of extremely low coefficient of expansion. The crystallized glass surface after cooling produces significant amount of pressure, up to 700 MPa, which can enhance the strength of glass.

Low-temperature ion exchange method includes the following steps: First, a monovalent cation (e.g., K ions)

undergoes ion exchange with the alkali ions (e.g. Na ion) on the surface layer at a temperature range that is lower than the strain point temperature, so as to allow the K ions penetrating the surface. For example, for manufacturing a $Na_2O$+ $CaO$+$SiO_2$ system glass, the glass can be impregnated for ten hours at more than four hundred degrees in the molten salt. The low temperature ion exchange method can easily obtain glass of higher strength, and the processing method is simple, does not damage the transparent nature of the glass surface, and not undergo shape distortion. Dealkalization includes of treating glass using platinum (Pt) catalyst along with sulfurous acid gas and water in a high temperature atmosphere. The Na+ ions are migrated out and bleed from the glass surface to be reacted with the Pt catalyst, so that whereby the surface layer becomes a $SiO_2$-rich layer, which results in being a low expansion glass and produces compressive stress upon cooling. Surface crystallization method and the high temperature type ion exchange method are different, but only the surface layer is treated by heat treatment to form low expansion coefficient microcrystals on the glass surface, thus reinforcing the glass. Sodium silicate glass strengthening method is a tempering method using sodium silicate (water glass) in water solution at 100 degrees Celsius and several atmospheres of pressure treatment, where a stronger/higher strength glass surface that is harder to scratch is thereby produced. The above glass tempering methods described including physical tempering methods and chemical tempering methods, in which various combinations of different tempering methods can also be combined together.

Figure 3:
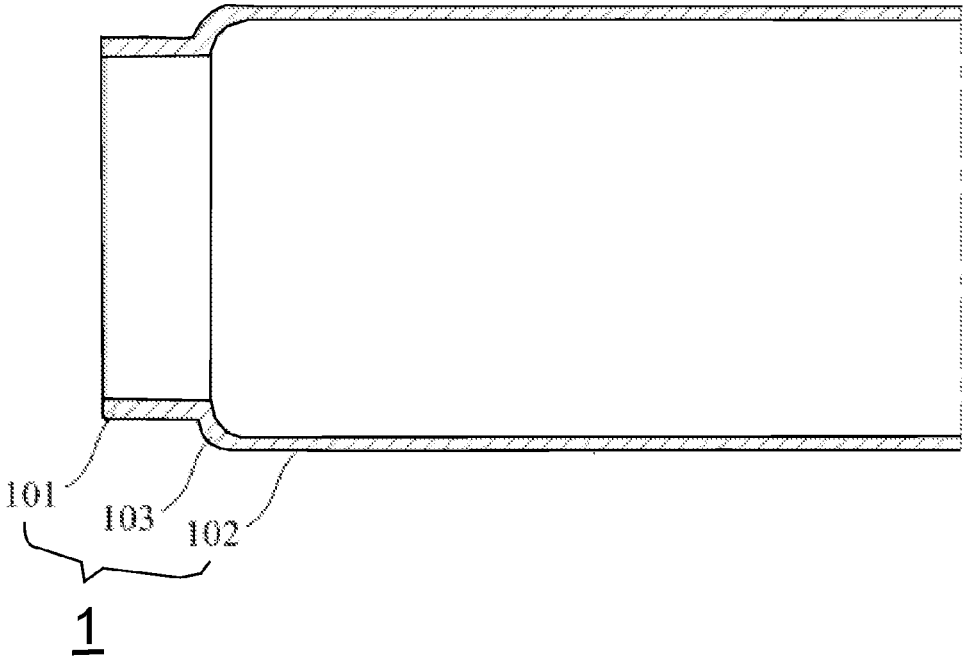
FIG. 3 is a cross-sectional partial view of a light tube of the LED tube light of the present invention at one end region thereof.
Figure 7:
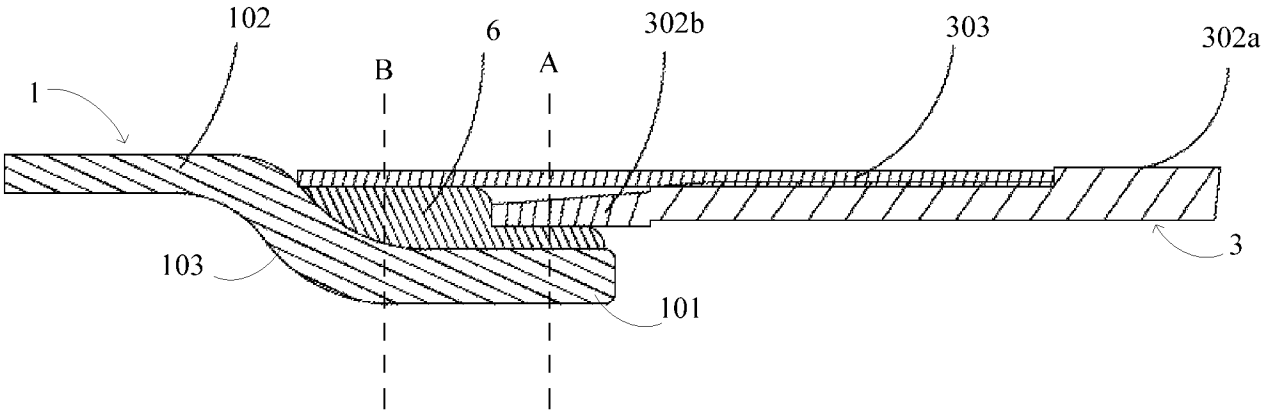
FIG. 7 is a cross-sectional partial view of a connecting region of the end cap and the light tube of the embodiment of the present invention.
Figure 9:
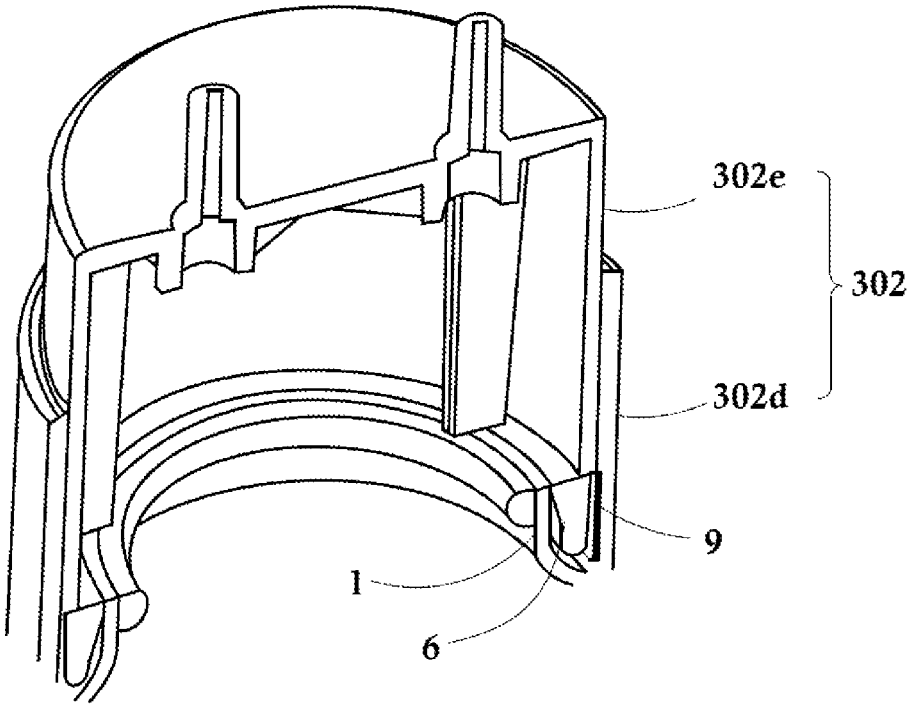
FIG. 9 is a perspective sectional schematic partial view of the all-plastic end cap of FIG. 8 showing internal structure thereof.

In the illustrated embodiment as shown in FIG. 3, the light tube 1 includes a main region 102, a plurality of rear end regions 101, and a plurality of transition regions 103. The light tube 1 is fabricated by undergoing a glass shaping process so as to form one or more narrowly curved end regions at one or more ends thereof, in which each narrowly curved end region includes one rear end region 101 and one transition region 103, from a cylindrical raw light tube. At the same time, the glass shaping process coincides to be substantially concurrently or is same as a glass toughening or tempering treatment process. In other words, while the light tube 1 is being toughened or tempered, the narrowly curved end regions as shown in FIG. 3 are also shaped alongside at the same time. Each transition region 103 is located between an end of the main region 102 and one rear end region 101. The rear end region 101 is connected to one end of the transition region 103, and the other end of the transition region 103 is connected to one end of the main region 102. In the illustrated embodiment, the number of the rear end regions 101 and the number of the transition regions 103 are two, respectively. The transition region 103 is curved or arc-shaped at both ends thereof under cross-sectional view. As illustrated in FIGS. 7 and 9, one end cap 3 is sleeved over the rear end region 101. The outer diameter of the rear end region 101 is less than the outer diameter of the main region 102. After undergone a glass toughening or tempering treatment process, the rear end regions 101 of the light tube 1 are formed to be a plurality of toughened glass structural portions. The end cap 3 is sleeved over the rear end region 101 (which is a toughened glass structural portion). The outer diameter of the end cap 3 is the same as the outer diameter of the main region 102 of the light tube 1.

Figure 4:
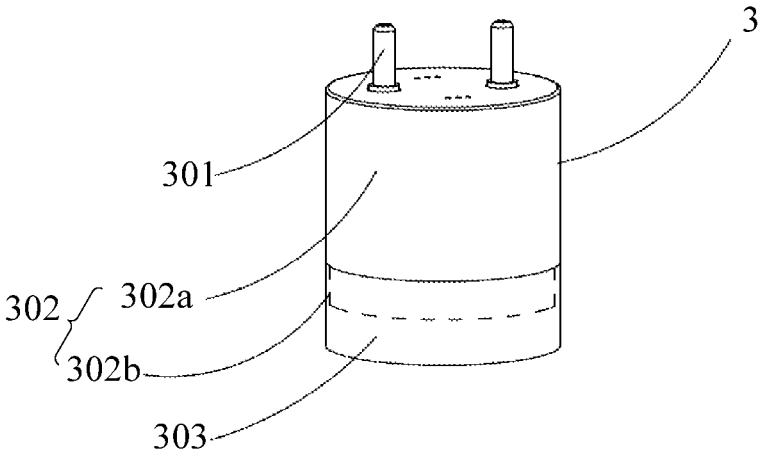
FIG. 4 is a frontal perspective schematic view of an end cap according to the embodiment of the LED tube light of the present invention.
Figure 5:
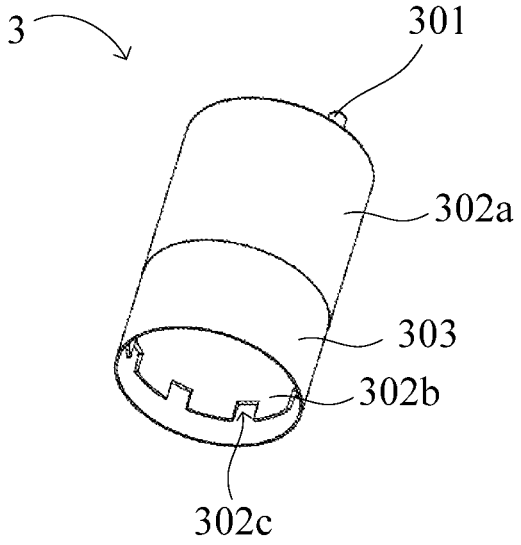
FIG. 5 is a bottom perspective view of another embodiment of the end cap of the present invention, showing the inside structure thereof.
Figure 6:
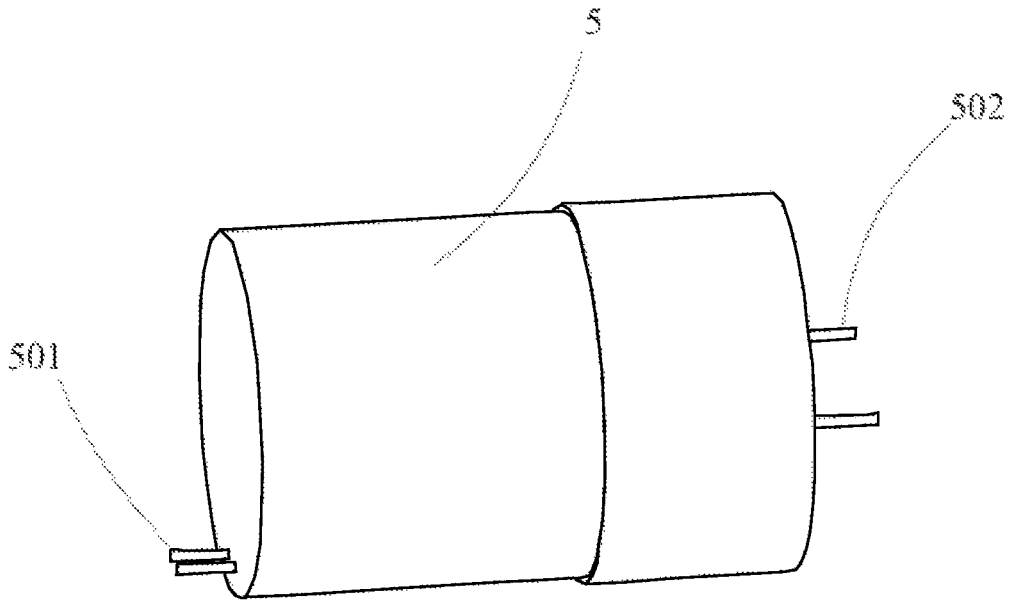
FIG. 6 is a side perspective view of a power supply of the LED tube light according to the embodiment of the present invention.

Referring to FIGS. 4 and 5, each end cap 3 includes a plurality of hollow conductive pins 301, an insulating tubular part 302 and a thermal conductive ring 303. The thermal conductive ring 303 is sleeved over the insulating tubular part 302. The hollow conductive pins 301 are disposed on the insulating tubular part 302. As shown in FIG. 7, one end of the thermal conductive ring 303 is protruded away from the insulating tubular part 302 of the end cap 3 towards one end of the light tube 1, of which is being bonded and adhered using a hot melt adhesive 6. As illustrated, the hot melt adhesive 6 formed a pool and then solidifies to fittingly join together the rear end region 101 and a portion of the transition region 103 of the light tube 1 to a portion of the thermal conductive ring 303 and a portion of the insulating tubular part 302 of the end cap 3. As a result, the end cap 3 is then joined to one end of the light tube 1 using the hot melt adhesive 6. The thermal conductive ring 303 of the end cap 3 is extending to the transition region 103 of the light tube 1. The outer diameter of the thermal conductive ring 303 is substantially the same as the outer diameter of the main region 102 of the light tube 1, and the outer diameter of the thermal conductive ring 303 is also substantially the same as the outer diameter of the insulating tubular part 302. The insulating tubular part 302 facing toward the light tube 1 and the transition region 103 has a gap therebetween. As a result, the LED tube light has a substantially uniform exterior diameter from end to end thereof. Because of the substantially uniform exterior diameter of the LED tube light, the LED tube light has a uniformly distributed stress point locations covering the entire span of the LED tube light (in contrast with conventional LED tube lights which have different diameters between the end caps 3 and the light tube 1, and often utilizes packaging that only contacts the end caps 3 (of larger diameter), but not the light tube 1 (of reduced diameter). Therefore, the packaging design configured for shipping of the light tube 1 of the embodiment of present invention can include more evenly distributed contact stress points at many more locations covering the entire span of the LED tube light, up to contacting along the entire outer surface of the LED tube light 1.

In the present embodiment, the outer diameter of the end caps 3 are the same as the outer diameter of the main region 102, and the tolerance for the outer diameter measurements thereof are preferred to be within +/−0.2 millimeter (mm), and should not exceed +/−1.0 millimeter (mm). The outer diameter difference between the rear end region 101 and the main region 102 can be 1 mm to 10 mm for typical product applications. Meanwhile, for preferred embodiment, the outer diameter difference between the rear end region 101 and the main region 102 can be 2 mm to 7 mm. The length of the transition region 103 is from 1 mm to 4 mm. Upon experimentation, it was found that when the length of the transition region 103 is either less than 1 mm or more than 4 mm, problems would arise due to insufficient strength or reduction in light illumination surface of the light tube. In alternative embodiment, the transition region 103 can be without curve or arc in shape. Upon adopting the T8 standard lamp format as an example, the outer diameter of the rear end region 101 is configured between 20.9 mm to 23 mm. Meanwhile, if the outer diameter of the rear end region 101 is less than 20.9 mm, the inner diameter of the rear end region 101 would be too small, thus rendering inability of the power supply to be fittingly inserted into the light tube 1. The outer diameter of the main region 102 is preferably configured to be between 25 mm to 28 mm.

Referring to FIG. 2, the LED light bar 2 of the embodiment of the present invention has a plurality of LED light sources 202 mounted thereon. The end cap 3 has a power supply 5 installed therein. The LED light sources 202 and the power supply 5 are electrically connected by the LED light bar 2. The power supply 5 may be in the form of a single individual unit (i.e., all of the power supply components are integrated into one module unit), and to be installed in one end cap 3; or alternatively, the power supply 5 may be divided into two separate units (i.e. all of the power supply components are divided into two parts) which are installed at the end caps 3, respectively. The number of units of the power supply 5 is corresponding to the number of the ends of the light tube 1 which had undergone glass tempering and strengthening process. In addition, the location of the power supply is also corresponding to the location of the light tube 1 which had undergone glass tempering. The power supply can be fabricated by encapsulation molding by using a high thermal conductivity silica gel (with thermal conductivity ≥0.7 w/m·k), or fabricated in the form of exposed power supply electronic components that are packaged by conventional heat shrink sleeve to be placed into the end cap 3. Referring to FIG. 2 and FIGS. 4-6, the power supply 5 includes a male plug 501 and a metal pin 502. The male plug 501 and the metal pin 502 are located at opposite ends of the power supply 5. The LED light bar 2 is configured with a female plug 201 at an end thereof. The end cap 3 is configured with a hollow conductive pin 301 used for coupling with an external power source. The male plugs 501 of the power supply 5 are fittingly engaged into the female plug 201 of the LED light bar 2, while the metal pins 502 of the power supply 5 are fittingly engaged into the hollow conductive pins 301 of the end cap 3. Upon inserting the metal pin 502 into the hollow conductive pin 301, a punching action is provided against the hollow conductive pin 31 using an external punching tool to create a slight amount of shape deformation of the hollow conductive pin 301, thereby securing and fixing the metal pin 502 of the power supply 5. Upon being energized or powered on, the electrical current passes through the hollow conductive pin 301, the metal pin 502, the male plug 501, and the female plug 201, to reach the LED light bar 2, and through the LED light bar 2 to reach the LED light sources 202. In other embodiments, the male plug 501 and the female plug 502 connection structure may not be employed, and conventional wire bonding techniques can be adopted for replacement.

Referring to FIGS. 4-5, and FIGS. 7-9, the end cap 3 is sleeved over the light tube 1. To be more specific, the end cap 3 is sleeved over the rear end region 101 and extending toward the transition region 103 so as to be partially overlapping with the transition region 103.

The hot melt adhesive 6 (includes a so-called commonly known as "weld mud powder") includes phenolic resin 2127, shellac, rosin, calcium carbonate powder, zinc oxide, and ethanol, etc. The light tube 1 at the rear end region 101 and the transition region 103 (as shown in FIG. 7) is coated by the hot melt adhesive, which when undergone heating, would be greatly expanded, so as to allow tighter and closer contact between the end cap 3 and the light tube 1, thus allowing for realization of manufacturing automation for LED tube light. Furthermore, the hot melt adhesive 6 would not be afraid of decreased reliability when operating under elevated temperature conditions by the power supply and other heating generating components. In addition, the hot melt adhesive 6 can prevent the deterioration of bond strength over time between the light tube 1 and the end cap 3, thereby improving long term reliability. Specifically, the hot melt adhesive 6 is filled in between an inner surface portion of the extending portion of the thermal conductive ring 303 and the outer peripheral surface of the light tube 1 at the rear end region 101 and the transition region 103 (location is shown in broken line B in FIG. 7). The hot melt adhesive 6 coating thickness can be 0.2 mm to 0.5 mm. After curing, the hot melt adhesive 6 expands and contacts with the light tube 1, thus fixing the end cap 3 to the light tube 1. Due to the difference in height between the outer surface of the rear end region 101 and the outer surface of the main region 102, thus avoiding overflow or spillover of the hot melt adhesive 6 to the main region 102 of the light tube 1, forsaking or avoiding having to perform manual adhesive wipe off or clean off, thus improving LED tube light production efficiency. Meanwhile, likewise for the embodiment shown in FIG. 9, a magnetic metal member 9 is fixedly arranged on an inner circumferential surface of the insulating tubular part 302, and bonded to an outer peripheral surface of the light tube 1 using the hot melt adhesive 6, in which the hot melt adhesive 6 does not spillover through the gap between the end cap and one of the transition regions 103 during the filling process of the hot melt adhesive 6. During fabrication process of the LED tube light, a thermal generating equipment is used to heat up the thermal conductive ring 303, and also heat up the hot melt adhesive 6, to thereby melt and expand thereof to securely attach and bond the end cap 3 to the light tube 1.

In the present embodiment, the insulating tubular part 302 of the end cap 3 includes a first tubular part 302*a* and a second tubular part 302*b*. The first tubular part 302*a* and the second tubular part 302*b* are connected along an axis of extension of the insulating tubular part 302. The outer diameter of the second tubular part 302*b* is less than the outer diameter of the first tubular part 302*a*. The outer diameter difference between the first tubular part 302*a* and the second tubular part 302*b* is between 0.15 mm to 0.30 mm. The thermal conductive ring 303 is configured over and surrounding the outer surface of the second tubular part 302*b*. The outer surface of the thermal conductive ring 303 is coplanar and with respect to the outer surface of the first tubular part 302*a*, in other words, the thermal conductive ring 303 and the first tubular part 302*a* have substantially uniform exterior diameters from end to end. As a result, the end cap 3 achieves an outer appearance of smooth and substantially uniform tubular structure. In the embodiment, ratio of the length of the thermal conductive ring 303 along the axial direction of the end cap 3 with respect to the axial length of the insulating tubular part 302 is from 1:2.5 to 1:5. In order to ensure bonding longevity using the hot melt adhesive, in the present embodiment, the second tubular part 302*b* is at least partially disposed around the light tube 1, the hot melt adhesive 6 is filled in an overlapped region (shown by the position A in dashed lines in FIG. 7) of the second tubular part 302*b* and the light tube 1, in which the second tubular part 302*b* and the light tube 1 are bonded by the hot melt adhesive 6. During manufacturing of the LED tube light, when the hot melt adhesive 6 is coated and applied between the thermal conductive ring 303 and the rear end region 101, it may be appropriate to increase the amount of hot melt adhesive used, such that in the subsequent heating process, the hot melt adhesive can be caused to expand and flow in between the second tubular part 302*b* and the rear end region 101, to thereby adhesively bond the second tubular part 302*b* and the rear end region 101.

During fabrication of the LED tube light, the rear end region 101 of the light tube 1 is inserted into one end of the end cap 3, the axial length of the portion of the rear end region 101 of the light tube 1 which had been inserted into the end cap 3 accounts for one-third to two-thirds of the axial length of the thermal conductive ring 303. One benefit is that, the hollow conductive pins 301 and the thermal conductive ring 303 have sufficient creepage distance therebetween, and thus is not easy to form a short circuit leading to dangerous electric shock to individuals. On the other hand, due to the insulating effect of the insulating tubular part 302, thus the creepage distance between the hollow conductive pin 301 and the thermal conductive ring 303 is increased, and thus more people are likely to obtain electric shock caused by operating and testing under high voltage conditions. In this embodiment, the insulating tube 302, in general state, is not a good conductor of electricity and/or is not used for conducting purposes, but not limited to the use made of plastics, ceramics and other materials. Furthermore, for the hot melt adhesive 6 disposed in the inner surface of the second tubular part 302*b*, due to presence of the second tubular part 302*b* interposed between the hot melt adhesive 6 and the thermal conductive ring 303, therefore the heat conducted from the thermal conductive ring 303 to the hot melt adhesive 6 may be reduced. Thus, referring to FIG. 5, in this another embodiment, the end of the second tubular part 302*b* facing the light tube 1 (i.e., away from the first tubular part 302*a*) is provided a plurality of notches 302*c*, configured for increasing the contact area of the thermal conductive ring 303 and the hot melt adhesive 6, in order to be more conducive to provide rapid heat conduction from the thermal conductive ring 303 to the hot melt adhesive 6, so as to accelerate the curing of the hot melt adhesive 6. Meanwhile, when the user touches the thermal conductive ring 303, due to the insulation property of the hot melt adhesive 6 located between the thermal conductive ring 303 and the light tube 1, no electrical shock would likely be produced by touching damaged portion of the light tube 1.

Figure 8:
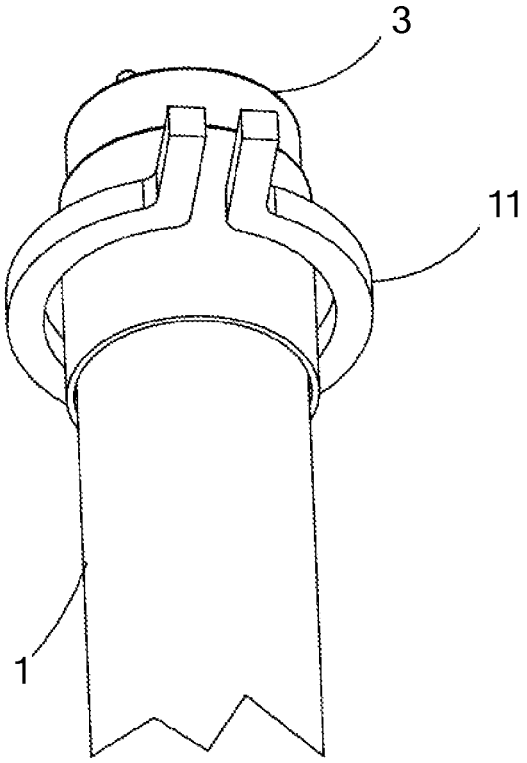
FIG. 8 is perspective illustrative schematic partial view of an all-plastic end cap and the light tube being bonded together by an induction coil heat curing process according to another embodiment of the present invention.

The thermal conductive ring can be made of various heat conducting materials, the thermal conductive ring 303 of the present embodiment is a metal sheet, such as aluminum alloy. The thermal conductive ring 303 being tubular or ring shaped, is being sleeved over the second tubular part 302*b*. The insulating tubular part 302 may be made of insulating material, but would have low thermal conductivity so as to prevent the heat conduction to reach the power supply components located inside the end cap 3, which then negatively affect performance of the power supply components. In this embodiment, the insulating tubular part 302 is a plastic tube. In other embodiments, the thermal conductive ring 303 may also be formed by a plurality of metal plates arranged along a plurality of second tubular part 302*b* in either circumferentially-spaced or not circumferentially-spaced arrangement. In other embodiments, the end cap may take on or have other structures. Referring to FIGS. 8-9, the end cap 3 according to another embodiment includes a magnetic metal member 9 and an insulating tubular part 302, but not a thermal conductive ring. The magnetic metal member 9 is fixedly arranged on the inner circumferential surface of the insulating tubular part 302, and has overlapping portions with respect to the light tube 1 in the radial direction. The hot melt adhesive 6 is coated on the inner surface of the magnetic metal member 9 (the surface of the magnetic metal tube member 9 facing the light tube 1), and bonding with the outer peripheral surface of the light tube 1. In order to increase the adhesion area, and to improve the stability of the adhesion, the hot melt adhesive 6 can cover the entire inner surface of the magnetic metal member 9. When manufacturing the LED tube light of the another embodiment, the insulating tubular part 302 is inserted in an induction coil 11, so that the induction coil 11 and the magnetic metal member 9 are disposed opposite (or adjacent) to one another along the radial extending direction of the insulating tubular part 302. A method for bonding the end cap 3 and the light tube 1 with the magnetic metal member 9 according to a second embodiment include the following steps. The induction coil 11 is energized. After the induction coil 11 is energized, the induction coil 11 forms an electromagnetic field, and the electromagnetic field upon contacting the magnetic metal member 9 then transform into an electrical current, so that the magnetic metal member 9 becomes heated. Then, the heat from the magnetic metal 9 is transferred to the hot melt adhesive 6, thus curing the hot melt adhesive 6 so as to bond the end cap 3 with the light tube 1. The induction coil 11 and the insulating tubular part 302 are coaxially aligned, so that the energy transfer is more uniform. In this embodiment, a deviation value between the axes of the induction coil 11 and the insulating tubular part 302 is not more than 0.05 mm. When the bonding process is complete, the induction coil 11 is removed away from the light tube 1. The insulating tubular part 302 is further divide into two portions, namely a first tubular part 302*d* and a second tubular part 302*e*. In order to provide better support of the magnetic metal member 9, the inner diameter of the first tubular part 302*d* at the inner circumferential surface of the insulating tubular part 302, for supporting the magnetic metal member 9, is larger than the inside diameter of the second tubular part 302*e*, and a stepped structure is formed by the insulating tubular part 302 and the second tubular part 302*e*, where an end of the magnetic metal member 9 as viewed in an axial direction is abutted against the stepped structure. Upon installation of the magnetic metal member 9, the entire inner surface of the end cap 3 is maintained flush. Additionally, the magnetic metal member 9 may be of various shapes, e.g., a sheet-like or tubular-like structures being circumferentially arranged or the like, where the magnetic metal member 9 is coaxially arranged with the insulating tubular part 302.

In other embodiments, the end cap can also be made of all-metal, which requires to further provide an insulating member beneath the hollow conductive pins as safety feature for accommodating high voltage usage.

In other embodiments, the magnetic metal member can have many small openings, in which the small openings can be circular, but not limited to being circular in shape, such as, for example, oval, square, star shaped, etc., as long as being possible to reduce the contact area between the magnetic metal member and the inner peripheral surface of the insulating tubular part, but while maintaining the function of melting and curing the hot melt adhesive. The opening structures can be arranged circumferentially around the magnetic metal member in an equidistantly spaced or not equally spaced manner. In other embodiments, the magnetic metal member has an indentation/embossed structure, in which the embossed features are formed from the outer surface toward the inner surface of the magnetic metal member, so long as the contact area between the inner peripheral surface of the insulating tubular part and the outer surface of the magnetic metal member is reduced, but can sustain the function of melting and curing the hot melt adhesive. In other embodiments, the magnetic metal member is a non-circular ring, such as, but not limited to an oval ring. When the light tube and the cap are both circular, the minor axis of the oval ring shape is slightly larger than the outer diameter of the end region of the light tube, so long as the contact area of the inner peripheral surface of the insulating tubular part and the outer surface of the magnetic metal member is reduced, but can achieve or maintain the function of melting and curing the hot melt adhesive. When the light tube and the end cap is circular, non-circular rings can reduce the contact area between the magnetic metal member and the inner peripheral surface of the insulating tubular part, but still can maintain the function of melting and curing hot melt adhesive. In other embodiments, the inner circumferential surface of the insulating tubular part has a supporting portion and a convex portion, in which the thickness of the convex portion is smaller than the thickness of the support portion. A stepped structure is formed at an upper edge of the support portion, in which the magnetic metal member is abutted against this upper edge. At least a portion of the convex portion is positioned between the inner peripheral surface of the insulating tubular part and the magnetic metal member. The arrangement of the convex portion may be in the circumferential direction of the insulating tubular part at equidistantly spaced or non-equidistantly spaced distances, the contact area of the inner peripheral surface of the insulating tubular part and the outer surface of the magnetic metal member is reduced, but can achieve or maintain the function of melting and curing the hot melt adhesive.

Figure 10:
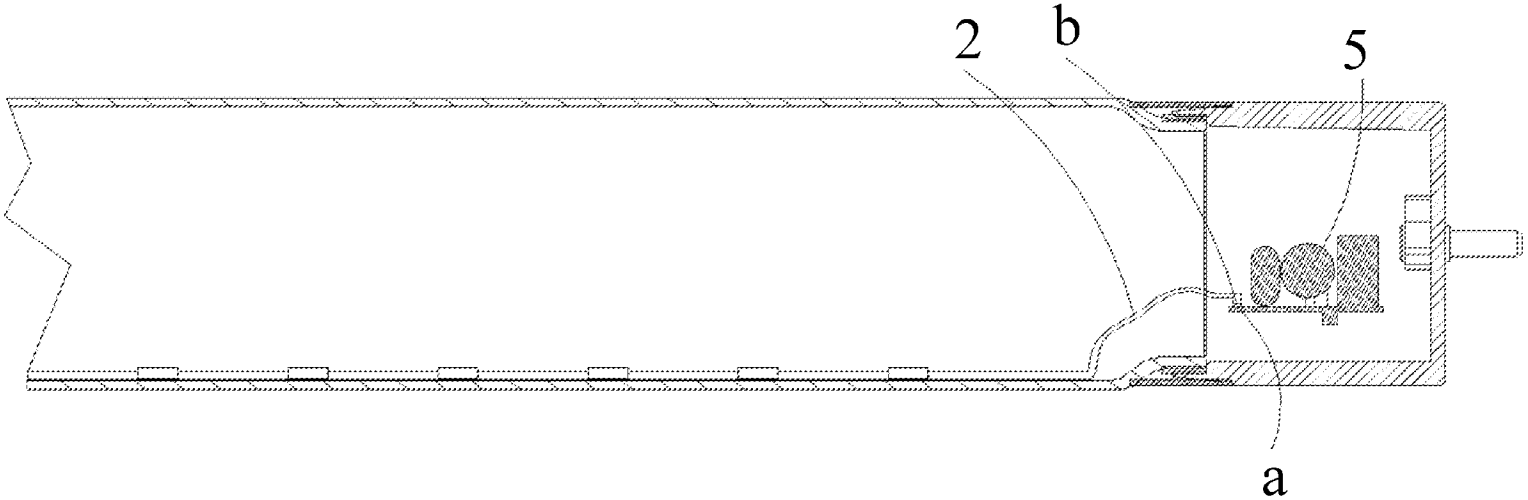
FIG. 10 is a sectional partial view of the connecting region of the light tube showing a connecting structure between the LED light bar and the power supply.
Figure 15:
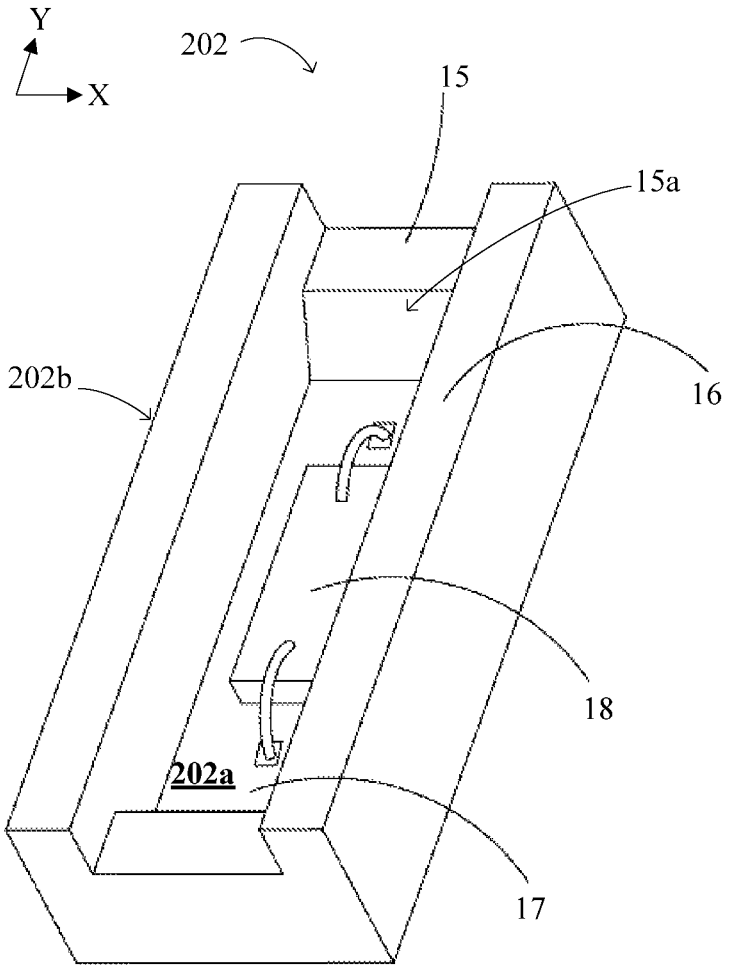
FIG. 15 is a perspective view of an LED leadframe for the LED light sources of the LED tube light of the embodiment of the present invention.

Referring again to FIG. 2, the LED tube light according to the embodiment of present invention also includes an adhesive 4, an insulation adhesive 7, and an optical adhesive 8. The LED light bar 2 is bonded onto the inner circumferential surface of the light tube 1 using the adhesive 4. In the illustrated embodiment, the adhesive 4 may be silicone adhesive, but is not limited thereto. The insulation adhesive 7 is coated on the surface of the LED light bar 2 facing the LED light sources 202, so that the LED light bar 2 is not exposed, thus insulating the LED light bar 2 and the outside environment. During application of the adhesive, a plurality of through holes 701 are reserved and set aside corresponding to the positions/locations of the LED light sources 202. The LED light sources 202 are mounted in the through holes 701. The material composition of the insulation adhesive 7 comprises vinyl silicone, hydrogen polysiloxane and aluminum oxide. The insulation adhesive 7 has a thickness range of 100 μm to 140 μm (microns). If less than 100 μm in thickness, the insulation adhesive 7 will not achieve sufficient insulating effect, but if more than 140 μm in thickness, the excessive insulation adhesive will result in material waste. An optical adhesive 8 is applied or coated on the surface of the LED light source 202. The optical adhesive 8 is a clear or transparent material, in order to ensure optimal light transmission rate. After providing coating application to the LED light sources 202, the shape or structure of the optical adhesive 8 may be in the form of a particulate gel or granular, a strip or a sheet. A preferred range for the refractive index of the optical adhesive 8 is between 1.22 to 1.6. Another embodiment of the optical adhesive 8 can have a refractive index value that is equal to a square root of the refractive index of the housing or casing of the LED light source 202, or equal to plus or minus 15% of the square root of the refractive index of the housing or casing of the LED light source 202, so as to achieve better light transmittance. The housing/casing of the LED light sources 202 is a housing structure to accommodate and carry the LED dies (or chips) such as a LED leadframe 202*b* as shown in FIG. 15. The refractive index range of the optical adhesive 8 in this embodiment is between 1.225 to 1.253. The thickness of the optical adhesive 8 can be in the range of 1.1 mm to 1.3 mm. When assembling the LED light sources to the LED light bar, the optical adhesive 8 is applied on the LED light sources 202; then the insulation adhesive 7 is coated on one side of the LED light bar 2. Then the LED light sources 202 are fixed on the LED light bar 2. The another side of the LED light bar 2 which is opposite to the side of which the LED light sources 202 are mounted thereon, is bonded and affixed using the adhesive 4 to the inner surface of the light tube 1. Later, the end cap 3 is fixed to the end portion of the light tube 1, while the LED light sources 202 and the power supply 5 are electrically connected. Alternatively, as shown in FIG. 10, the LED light bar 2 can be used to pass through the transition region 103 for providing electrical coupling to the power supply 5, or traditional wire bonding methods can be adopted to provide the electrical coupling as well. A finished LED tube light is then fabricated upon the attachment or joining of the end caps 3 to the light tube 1 as shown in FIG. 7 (with the structures shown in FIGS. 4-5), or as shown in FIG. 8 (with the structure of FIG. 9).

In the embodiment, the LED light bar 2 is fixed by the adhesive 4 to an inner circumferential surface of the light tube 1, so that the LED light sources 202 are mounted in the inner circumferential surface of the light tube 1, which can increase the illumination angle of the LED light sources 202, thereby expanding the viewing angle, so that an excess of 330 degrees viewing angle is possible to achieve. Through the utilization of applying the insulation adhesive 7 on the LED light bar 2 and applying of the optical adhesive 8 on the LED light sources, the electrical insulation of the LED light bar 2 is provided, so that even when the light tube 1 is broken, electrical shock does not occur, thereby improving safety.

Furthermore, the LED light bar 2 may be a flexible substrate, an aluminum plate or strip, or a FR4 board, in an alternative embodiment. Since the light tube 1 of the embodiment is a glass tube. If the LED light bar 2 adopts rigid aluminum plate or FR4 board, then when the light tube has been rupture, e.g., broken into two parts, the entire light tube is still able to maintain a straight pipe configuration, then the user may be under a false impression the LED tube light can remain usable and fully functional and easy to cause electric shock upon handling or installation thereof. The LED light bar 2 allows a ruptured or broken light tube to not being able to maintain a straight pipe configuration so as to better inform the user that the LED tube light is rendered unusable so as to avoid potential electric shock accidents from occurring.

Figure 11:
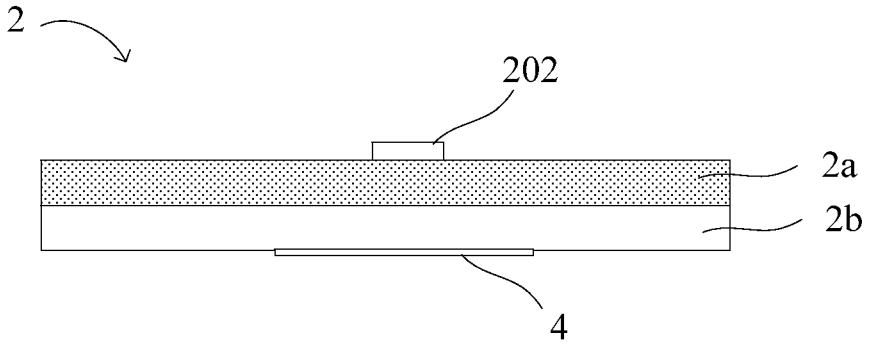
FIG. 11 is a cross-sectional view of a bi-layered flexible substrate of the LED tube light of the embodiment of the present invention.

Referring to illustrated embodiment of FIG. 11, the LED light bar 2 includes a conductive layer 2*a* and a dielectric layer 2*b*. The LED light source 202 is disposed on a surface of the conductive layer 2*a* away from the dielectric layer 2*b*. Meanwhile, the adhesive 4 is disposed on a surface of the dielectric layer 2*b* away from the conductive layer 2*a* to bond to the inner circumferential surface of the light tube 1. The conductive layer 2*a* can be a metal layer serving as a power supply layer. In alternative embodiment, the LED light bar 2 further includes a circuit protection layer. In another alternative embodiment, the dielectric layer can be omitted, in which the conductive layer is directly bonded to the inner circumferential surface of the light tube. The circuit protection layer can be an ink material, possessing functions as solder resist and optical reflectance. Whether the conductive layer is one layered, or two-layered, the circuit protective layer can be adopted. The circuit protection layer can be disposed on the side/surface of the LED light bar 2, such as the same surface of the conductive layer which has the LED light source disposed thereon. It should be noted that, in the present embodiment, the LED light bar 2 mounted close to the tube wall is one preferred configuration, and the fewer number of layers of the LED light bar 2, the better the heat dissipation effect, and the lower the material cost. Furthermore, the inner peripheral surface of the light tube 1 or the outer circumferential surface thereof is covered with an adhesive film (not shown), for the sake of isolating the inner content from outside content of the light tube 1 after the light tube 1 has been ruptured. The present embodiment has the adhesive film coated on the inner peripheral surface of the light tube 1.

In a preferred embodiment, the light tube 1 can be a glass tube with a coated adhesive film on the inner wall thereof (not shown). The coated adhesive film also serves to isolate and segregate the inside and the outside contents of the light tube 1 upon being ruptured thereof. The coated adhesive film material includes methyl vinyl silicone oil, hydro silicone oil, Xylene, and calcium carbonate, with a ratio of 20:20.4:3.8:3.1, the thickness of the coated adhesive film can be between 10 to 800 microns (μm), but the preferred thickness of the coated adhesive film can be between 100 to 140 microns (μm). This is because the bonding adhesive thickness being less than 100 microns, does not have sufficient shatterproof capability for the glass tube, and thus the glass tube is prone to crack or shatter. At above 140 microns of bonding adhesive thickness would reduce the light transmittance rate, and also increase material cost. Xylene is used as an auxiliary material. Upon solidifying or hardening of the bonding adhesive, the xylene will be volatilized and removed. The xylene is mainly used for the purpose of adjusting the degree of adhesion or adhesiveness, which can then adjust the thickness of the bonding adhesive thickness. Vinyl silicone oil+hydrosilicone oil allowable ratio range is (19.8-20.2):(20.2-20.6), but if exceeding this allowable ratio range, would thereby negatively affect the adhesiveness or bonding strength. The allowable ratio range for the xylene and calcium carbonate is (2-6):(2-6), and if lesser than the lowest ratio, the light transmittance of the light tube will be increased, but grainy spots would be produced or resulted from illumination of the LED light tube, negatively affect illumination quality and effect. On the other hand, if larger than the highest ratio, the light transmittance will be decreased, which can be fallen to be below the 85% transmittance minimum requirement. The methyl vinyl silicone oil chemical formula is: $(C_2H_8OSi)n.C_2H_3$. The hydrosilicon oil chemical formula is: $C_3H_9OSi.(CH_4OSi)n.C_3H_9Si$; and the product produced is polydimethylsiloxane (silicone elastomer), which has chemical formula as follow:

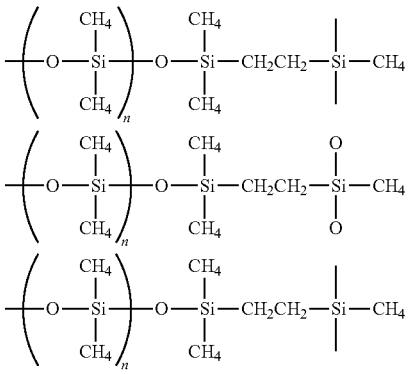

If the LED light bar 2 is configured to be a flexible substrate, no coated adhesive film is thereby required.

Figure 12:
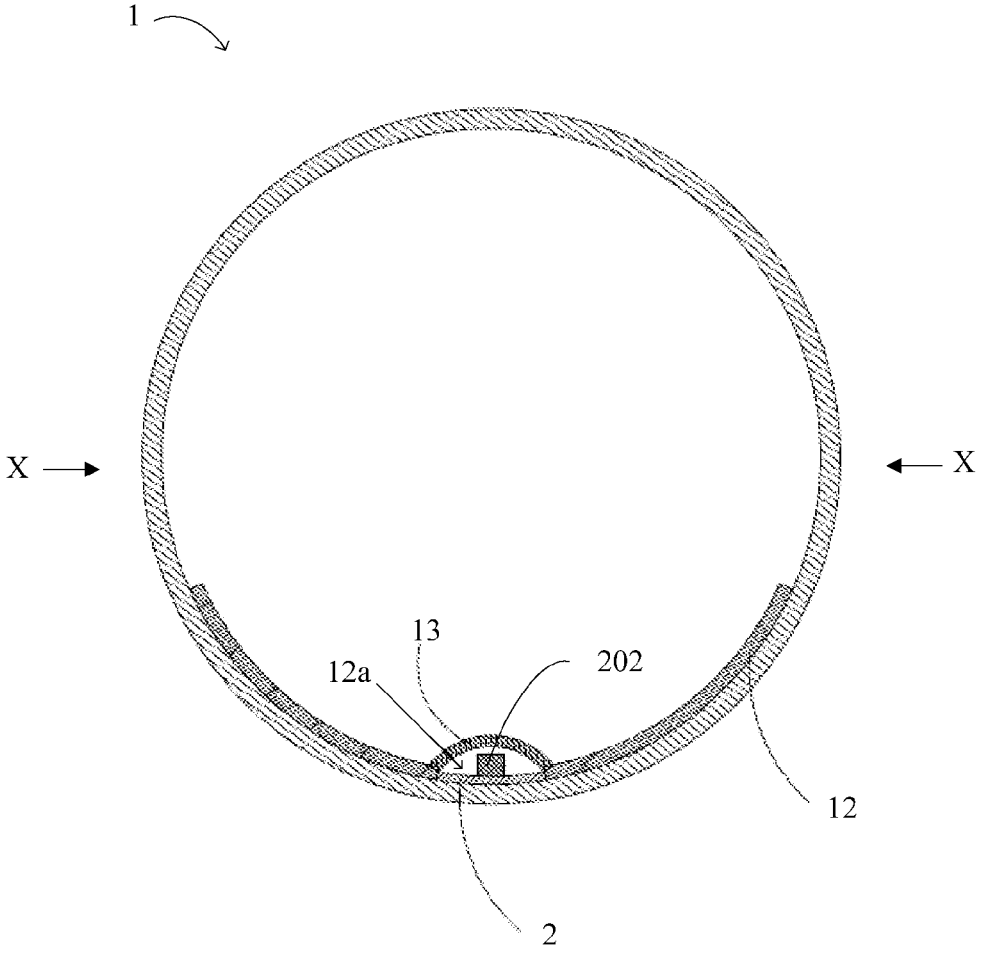
FIG. 12 is an end cross-sectional view of the light tube of the LED tube light of a first embodiment of present invention as taken along axial direction thereof.

To improve the illumination efficiency of the LED tube light, the light tube 1 has been modified or customized according to a first embodiment of present invention by having a diffusion film layer 13 coated and bonded to the inner wall thereof as shown in FIG. 12. The diffusion film layer 13 allows for improved illumination distribution uniformity of the light outputted by the LED light sources 202. The diffusion film layer 13 can be coated onto different locations, such as onto the inner wall of the light tube 1 or onto the diffusion coating layer (not shown) at the surface of each LED light source 202, or coated onto a separate membrane cover covering the LED light source 202. The diffusion film layer 13 in the illustrated embodiment is a diffusion film that is not in contact with the LED light source 202. The diffusion layer 13 can be an optical diffusion film or sheet, usually made of polystyrene (PS), polymethyl methacrylate (PMMA), polyethylene terephthalate (PET), and/or polycarbonate (PET), in one composite material composition thereof. In alternative embodiment, the diffusion layer can be a diffusion coating, which has a material composition to include at least one of calcium carbonate and strontium phosphate that possesses excellent light diffusion and transmittance to exceed 90%. Further, the applying of the diffusion layer made of diffusion coating material to outer surface of the rear end region 101 along with the hot melt adhesive would produce increased friction between the end cap and the light tube which is beneficial for preventing accidental detachment of the end cap from the light tube. Composition of the diffusion layer made by the diffusion coating for the alternative embodiment includes calcium carbonate and strontium phosphate (e.g., CMS-5000, white powder), thickening agents (e.g., thickeners DV-961, milky white liquid), and a ceramic activated carbon (e.g., ceramic activated carbon SW-C, which is a colorless liquid). Wherein, the chemical name for the thickener DV-961 is colloidal silica modified acrylic resin, whose components include acrylic resins, silicone and deionized water; ceramic activated carbon SW-C components include Sodium Di(2-ethylhexyl)Sulfosuccinate, isopropanol and deionized water, wherein the Sodium Di(2-ethylhexyl)Sulfosuccinate has the formula:

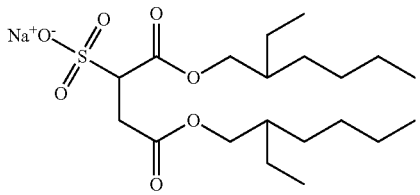

Specifically, average thickness of the diffusion coating falls between 20~30 μm after being coated on the inner circumferential surface of the glass tube, where finally the deionized water will be evaporated, leaving behind the calcium carbonate, ceramic activated carbon and the thickener. Using this diffusion coating material for forming the diffusion film layer 13, a light transmittance of about 90% can be achieved. In addition, this diffusion film layer 13 can also provide electrical isolation for reducing risk of electric shock to a user upon breakage of the light tube. Furthermore, the diffusion film layer 13 provides an improved illumination distribution uniformity of the light outputted by the LED light sources 202 so as to avoid the formation of dark regions seen inside the illuminated or lit up light tube 1. In other embodiments, the diffusion coating can also be made of strontium phosphate (or a mixture of calcium carbonate and strontium phosphate) along with a thickening agent, ceramic activated carbon and deionized water.

Figure 13:
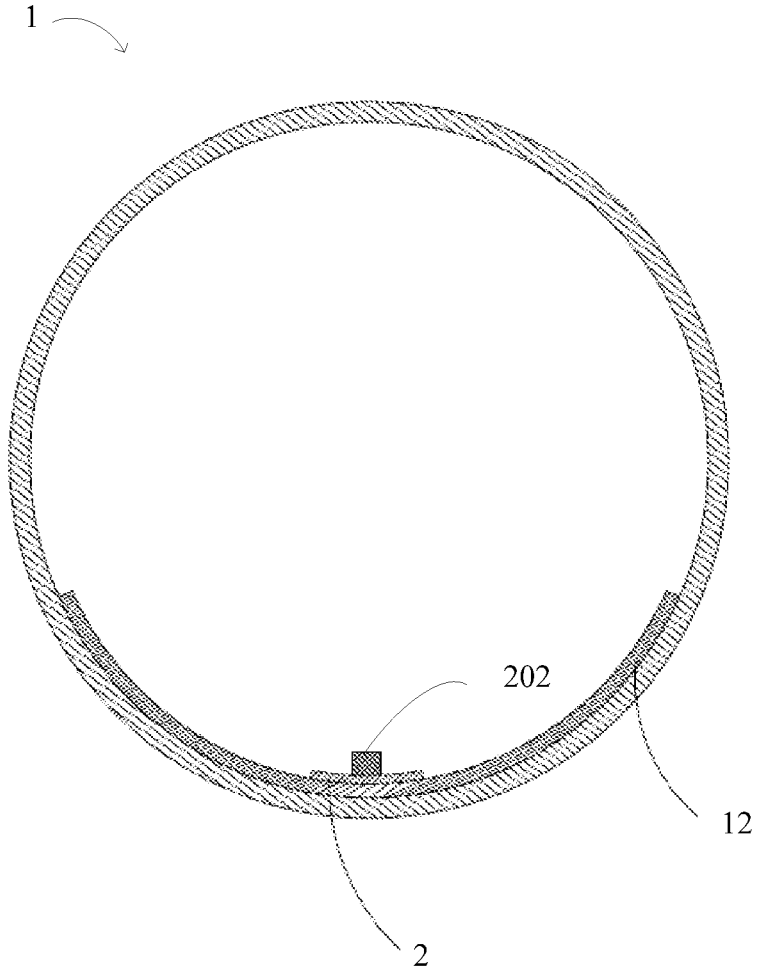
FIG. 13 is an end cross-sectional view of the light tube of the LED tube light of another embodiment of present invention as taken along axial direction thereof.

Furthermore, as shown in FIG. 12, the inner circumferential surface of the light tube 1 is also provided with a reflective film layer 12, the reflective film layer 12 is provided around the LED light sources 202, and occupy a portion of the inner circumferential surface of the light tube 1 arranged along the circumferential direction thereof. As shown in FIG. 12, the reflective film layer 12 is disposed at two sides of the LED light sources 202 extending along circumferential direction of the light tube. The reflective film layer 12 when viewed by a person looking at the light tube from the side (in the X-direction shown in FIG. 12) serve to block the LED light sources 202, so that the person does not directly see the LED light sources 202, thereby reducing the visual graininess effect. On the other hand, reflection light passes through the reflective film 12 emitted from the LED light source 202, can control the divergence angle of the LED tube light, so that more light is emitted in the direction that has been coated with the reflective film, such that the LED tube light has higher energy efficiency when providing same level of illumination performance. Specifically, the reflection film layer 12 provided on the inner peripheral surface of the light tube 1, and has a plurality of openings 12*a* on the reflective film layer 12 which are configured corresponding to the LED light sources 202, the sizes of the openings 12*a* are the same or slightly larger than the size of the LED light source 202. During assembly, the LED light sources 202 are mounted on the LED light bar 2 (or flexible substrate) provided on the inner surface of the light tube 1, and then the reflective film layer 12 is adhered to the inner surface of the light tube, so that the openings 12*a* of the reflective film layer 12 are matched to the corresponding LED light sources 202 in a one-to-one relationship, and the LED light sources 202 are exposed to the outside of the reflective film layer 12. In the present embodiment, the reflectance of the reflective film layer 12 is at least greater than 85%. Better reflectance of 90% can also be achieved. Meanwhile, more preferably reflectance at more than 95% reflectance can also be achievable, in order to obtain more reflectance. The reflective film layer 12 extends circumferentially along the length of the light tube 1 occupying about 30% to 50% of the inner surface area of the light tube 1. The reflective film layer 12 material may be made of PET, with a thickness between 140 μm to 350 μm, or between 150 μm to 220 μm for a more preferred embodiment. In other embodiments, the reflective film layer 12 may be provided in other forms, for example, along the circumferential direction of the light tube 1 on one or both sides of the LED light source 202, while occupying the same 30% to 50% of the inner surface area of the light tube 1. Alternatively, as shown in FIG. 13, the reflective film layer 12 can be without any openings, so that the reflective film layer 12 is directly adhered to the inner surface of the light tube 1, and followed by mounting the LED light bar 2, with the LED light sources 202 already being mounted thereon, on top of the reflective film layer 12. In another embodiment, just the reflection film layer 12 may be provided without a diffusion layer being present, as shown in FIG. 14.

In other embodiments, the width of the LED light bar 2 can be widened to occupy a circumference area of the inner surface of the light tube 1 at a ratio between 0.3 to 0.5, in which the widened portion of the LED light bar 2 can provide reflective effect similar to the reflective film. As described in the above embodiment, the LED light bar 2 may be coated with a circuit protection layer, the circuit protection layer may be an ink material, providing an increased reflective function, with a widened flexible substrate using the LED light sources as starting point to be circumferentially extending, so that the light is more concentrated.

Figure 14:
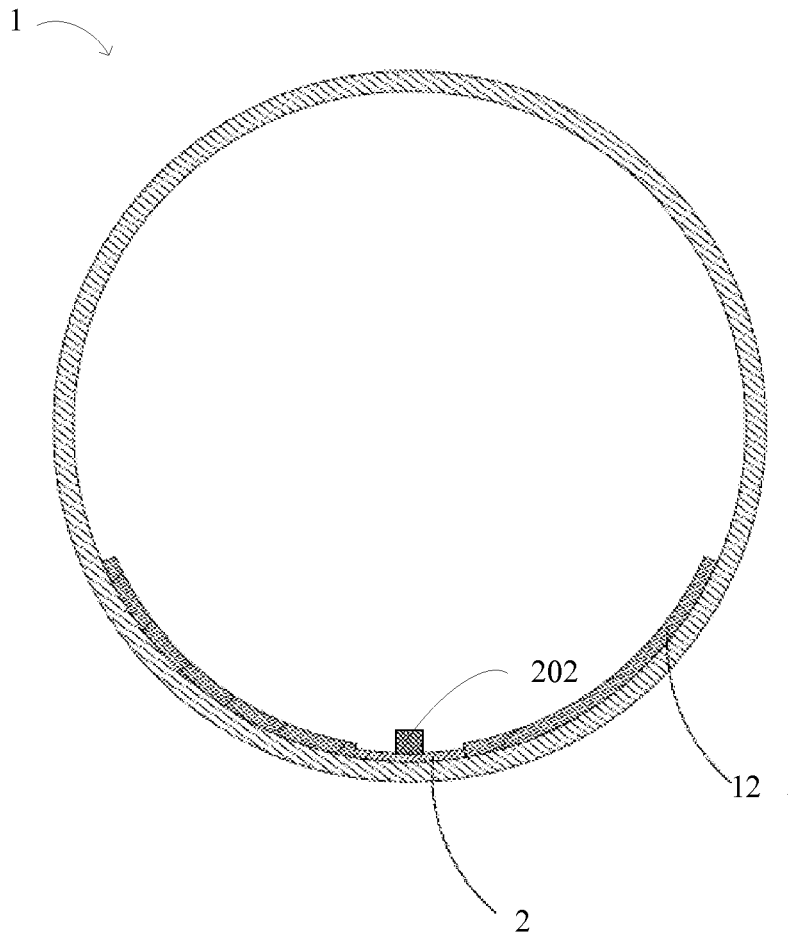
FIG. 14 is an end cross-sectional view of the light tube of the LED tube light of yet another embodiment of present invention as taken along axial direction thereof.

In the embodiment shown in FIGS. 12-14, the inner circumferential surface of the glass light tube, can be coated entirely or partially with a diffusion coating (parts that have the reflective film being coated would not be coated by the diffusion coating). The diffusion coating is preferably applied to the outer surface at the end region of the light tube 1, so that the end cap 3 and the light tube 1 can be bonded more firmly.

Referring to FIG. 15, the LED light source 202 may be further modified to include a LED leadframe 202*b* having a recess 202*a*, and an LED chip 18 disposed in the recess 202*a*. The recess 202*a* is filled with phosphor, the phosphor coating is covered on the LED chip 18 to convert to the desired color light. In one light tube 1, there are multiple number of LED light sources 202, which are arranged into one or more rows, each row of the LED light sources 202 is arranged along the axis direction (Y direction) of the light tube 1. The recess 202*a* belonging to each LED leadframe 202*b* may be one or more. In the illustrated embodiment, each LED leadframe 202*b* has one recess 202*a*, and correspondingly, the LED leadframe 202*b* includes two first sidewalls 15 arranged along a length direction (Y-direction) of the light tube 1, and two second sidewalls 16 arranged along a width direction (X-direction) of the light tube 1. In the present embodiment, the first sidewall 15 is extending along the width direction (X direction) of the light tube 1, the second sidewall 16 is extending along the length direction (Y-direction) of the light tube 1. The first sidewall 15 is lower in height than the second sidewall 16. The recess 202*a* is enclosed by the first sidewalls 15 and the second sidewalls 16. When the user is viewing the along the X-direction toward the light tube, the second sidewall 16 can block the line of sight of the user to the LED light source 202, thus reducing unappealing grainy spots. The first sidewall 15 can be extended along the width direction of the light tube 1, and may be in a different structure such as zigzag, curved, wavy, and the like. The second sidewall 16 can be extended along the length direction of the light tube 1, and may be in a different structure such as zigzag, curved, wavy, and the like. Having the first sidewall 15 being of a lower height than the second sidewall 16 is beneficial for allowing light illumination to easily dispersed beyond the LED leadframe 202*b*, and no grainy effect is produced upon viewing in the Y-direction. The first sidewall 15 includes an inner surface 15*a*. The inner surface 15*a* is a sloped surface, which promotes better light guiding effect for illumination. The inner surface 15*a* can be a flat or curved surface. The slope of the inner surface 15*a* is between about 30 degrees to 60 degrees. In other words, the included angle between the bottom surface of the recess 202*a* and the inner surface 15*a* is between 120 and 150 degrees. In other embodiments, the slope of the inner surface of the first sidewall can also be between about 15 degrees to 75 degrees, that is, the included angle between the bottom surface of the recess 202*a* and the inner surface is between 105 degrees to 165 degrees. Alternatively, the slope may be a combination of flat and curved surface.

In one embodiment, the LED light bar includes a dielectric layer and one conductive layer, in which the dielectric layer and the conductive layer are arranged in a stacking manner.

The narrowly curved end regions of the glass tube can reside at two ends, or can be configured at just one end thereof in different embodiments.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An LED tube light, comprising:

a plurality of LED light sources;

a light tube including a main region, a plurality of end regions, and a plurality of transition regions;

an LED light bar, disposed inside the light tube, the LED light sources being mounted on the LED light bar;

a magnetic metal member; and a plurality of end caps, each of the end caps having an electrically-insulating tubular part;

wherein each of the end caps is sleeved over a respective end region of the light tube, an outer diameter of each end region is less than the outer diameter of the main region, the outer diameter of the main region is substantially the same as the outer diameter of each end cap, each transition region forms a curved region, the magnetic metal member is fixedly arranged on an inner circumferential surface of the electrically-insulating tubular part, and bonded to an outer peripheral surface of the light tube using a hot melt adhesive formed between the outer peripheral surface of the light tube at one end region and the inner circumferential surface of the electrically-insulating tubular part of one end cap, the hot melt adhesive does not spillover through the gap between the one end cap and one of the transition regions, and outer surfaces of the transition regions are under compression and inner surfaces of the transition regions are under tension.

2. The LED tube light of claim 1, wherein the hot melt adhesive is coated on an inner circumferential surface of the magnetic metal member facing the light tube.

3. The LED tube light of claim 1, wherein the LED tube light has a substantially uniform exterior diameter from end to end thereof.

4. An LED tube light, comprising:

a plurality of LED light sources;

a light tube, including a main region, two end regions and two transition regions, the main region being connected to the two transition regions, the two end regions being respectively connected to the two transition regions;

an LED light bar, disposed inside the light tube for allowing the plurality of LED light sources to be mounted thereon; and two end caps, each of the end caps having an electrically-insulating tubular part;

wherein the light tube is made of glass, the end caps are respectively sleeved over the end regions of the light tube, and each outer diameter of the two end regions is less than the outer diameter of the main region, the transition region being arc-shaped at both ends, one arc thereof near the main region is curved towards inside of the glass light tube, and the other arc thereof near the end region is curved toward outside of glass light tube, and wherein:

a hot melt adhesive, thermal conductive ring or magnetic metal member, and part of the electrically-insulating tubular part are radially stacked on the light tube glass at each end region, so that an outer diameter of the stack is substantially the same as the outer diameter of the main region of the light tube.

5. The LED tube light of claim 4, wherein each of the outer diameter differences between the end regions and the main region is 1 mm to 10 mm.

6. The LED tube light of claim 4, wherein the light tube has a diffusion film layer coated to the inner wall thereon, and the material of the diffusion film layer comprises at least one of calcium carbonate and strontium phosphate.

7. The LED tube light of claim 4, wherein each of the transition regions has a length of 1 mm to 4 mm.

8. The LED tube light of claim 4, wherein the LED light bar includes one dielectric layer, one electrically-conductive layer, and a circuit protection layer, the LED light source is disposed on a surface of the electrically-conductive layer away from the dielectric layer, an adhesive is disposed on a surface of the dielectric layer away from the electrically-conductive layer to be bonded to the inner circumferential surface of the light tube, and the circuit protection layer is disposed on the same surface of the electrically-conductive layer which has the LED light source disposed thereon.

9. The LED tube light of claim 4, wherein the outer diameter of the end region is between 20.9 mm to 23 mm.

10. The LED tube light of claim 6, wherein the diffusion film layer is a diffusion coating with thickness of 20 μm to 30 μm.

11. The LED tube light of claim 4, wherein each of the end caps comprises a thermal conductive ring sleeved over the electrically-insulating tubular part, one end of the thermal conductive ring extends beyond the electrically-insulating tubular part towards one end of the light tube, and the hot melt adhesive is disposed between each end region and the respective end cap, and is disposed at the transition regions of the light tube, the electrically-insulating tubular parts, and the thermal conductive rings of the end caps.

12. The LED tube light of claim 4, wherein the LED tube light has a substantially uniform exterior diameter from end to end thereof.

13. The LED tube light of claim 12, wherein each outer diameter of the end caps and the outer diameter of the main region have a difference therebetween with an average tolerance of up to +/−1 mm.

14. The LED tube light of claim 11, further comprising a power supply disposed inside the end caps to provide electric coupling to the light bar, wherein the LED light bar is passed through the transition regions to be electrically coupled to the power supply.

15. The LED tube light of claim 4, wherein the end region is a flat end.

16. The LED tube light of claim 4, wherein the thermal conductive ring or magnetic metal member is a magnetic metal member, which is disposed between an inner circumferential surface of the end cap and the end region of the light tube.

17. The LED light tube of claim 4, wherein the transition regions are narrowed down smoothly and continuously from the main region to the end region.

18. The LED tube light of claim 4, wherein the thermal conductive ring or magnetic metal member is a thermal conductive ring disposed on an outer surface of the electrically-insulating tubular part, such that both part of the electrically-insulating tubular part and the hot melt adhesive are between the thermal conductive ring and the light tube.

19. The LED tube light of claim 18, wherein both the thermal conductive ring and the electrically-insulating tubular part radially overlap with the end region of the light tube.

* * * * *